US010882673B2

(12) United States Patent
Shah et al.

(10) Patent No.: US 10,882,673 B2
(45) Date of Patent: Jan. 5, 2021

(54) DUAL-SEAL LINER AND NON-REMOVABLE CLOSURE ASSEMBLY

(71) Applicant: Tekni-Plex, Inc., Wayne, PA (US)

(72) Inventors: Munish Shah, Sylvania, OH (US); David Andrulonis, Miamisburg, OH (US)

(73) Assignee: Tekni-Plex, Inc., Wayne, PA (US)

( * ) Notice: Subject to any disclaimer, the term of this patent is extended or adjusted under 35 U.S.C. 154(b) by 192 days.

(21) Appl. No.: 16/199,340

(22) Filed: Nov. 26, 2018

(65) Prior Publication Data

US 2020/0165044 A1 May 28, 2020

(51) Int. Cl.

| | |
|---|---|
| ***B65D 37/00*** | (2006.01) |
| ***B65D 55/02*** | (2006.01) |
| *B65D 41/04* | (2006.01) |
| *B65D 51/20* | (2006.01) |

(52) U.S. Cl.

CPC ..... *B65D 55/024* (2013.01); *B65D 41/045* (2013.01); *B65D 51/20* (2013.01)

(58) Field of Classification Search

CPC .. B65D 55/024; B65D 55/249; B65D 41/045; B65D 41/2031; B65D 51/20; B65D 1/0223

USPC ..... 220/266, 212

See application file for complete search history.

(56) References Cited

U.S. PATENT DOCUMENTS

| | | | | |
|---|---|---|---|---|
| 6,378,715 B1 | 4/2002 | Finkelstein et al. | | |
| 7,648,764 B2 | 1/2010 | Yousif | | |
| 7,900,789 B2 * | 3/2011 | Johnston | B65D 55/022 | 215/330 |
| 8,080,118 B2 | 12/2011 | Yousif | | |
| 8,863,991 B2 * | 10/2014 | Cleary | B65D 47/0828 | 222/215 |
| 2012/0132609 A1 * | 5/2012 | Cleary | B65D 23/102 | 215/43 |

FOREIGN PATENT DOCUMENTS

| | | |
|---|---|---|
| CN | 20667955 | 11/2017 |
| WO | 2018200662 A1 | 11/2018 |

OTHER PUBLICATIONS

International Search Report and Written Opinion in corresponding international application PCT/US2019/062539 dated Apr. 3, 2020.

* cited by examiner

*Primary Examiner* — King M Chu
(74) *Attorney, Agent, or Firm* — Polsinelli, PC

(57) ABSTRACT

Non-removable closure assembly that resists rotational movement so as to be rendered substantially non-removable by the consumer. An induction heat seal liner is provided for sealing the finish (open end or mouth) of a plastic container, the liner being disposed between a closure cap and the container finish and being heat seal bonded to both, thus rendering the closure cap non-removable from the container finish. By non-removable it is meant that once heat seal bonded together the closure cap cannot be removed by a customer or consumer (a human) by hand, without substantially distorting the closure cap or container, e.g., it would require the human to use a mechanical tool (e.g., knife or wrench) and in the process of trying to remove the cap with the tool it would substantially deform the closure cap or container and render one or more of them unusable for their intended purpose.

36 Claims, 9 Drawing Sheets

DUAL-SEAL LINER AND NON-REMOVABLE CLOSURE ASSEMBLY

FIELD OF THE INVENTION

The invention relates to a dual-seal liner configured to be bonded between a closure and container to form a non-removable closure assembly that substantially resists rotational movement and is rendered substantially non-removable by the customer.

BACKGROUND OF THE INVENTION

There are a variety of food, beverage and healthcare products for which a non-removable closure would be advantageous. A non-removable closure system is generally understood to be one in which, following attachment of the closure to the container body, the closure cannot be detached from the container without deliberately applying such large forces that would at least partially damage the container and/or the closure. Such damage would thus prevent continued use of the container body and/or closure.

For example, it is well known to provide an injection molded preform with an upper relatively thick finish portion for forming the mouth of the container, and a lower preform body portion that is subsequently blow molded to form a relatively thin container body. The relatively thick finish portion has an external thread and provides the necessary structural strength for secure application of a closure having a complementary internal thread, while the expanded container body is sufficiently strengthened (e.g., by biaxial orientation) to withstand product filling, handling and expected use. In some applications the closure has a dispensing aperture allowing the product to be dispensed without removal of the closure, often by providing a flip-top that can be repeatedly opened and closed to open and close the dispensing aperture as needed. The container body portion, which is thinner and more flexible than the finish area, can be squeezed by the consumer, while holding the container upside down, to assist in dispensing product through the open dispensing aperture. The preform(s)/container(s) for such applications are typically made from thermoplastic polymers such as polyesters (e.g., polyethylene terephthalate PET) and polyolefins (e.g., polypropylene or polyethylene). The closure is also typically a molded plastic article, formed separately from the container, and may be made of polyolefin or polyester.

Most applications for such thermoplastic containers and closures are single fill applications, wherein the container and closure are essentially discarded after all or most of the product is dispensed. In such applications, it is desirable to minimize the amount of material required, and minimize the complexity of the injection and blow molding equipment, in order to produce a container and closure assembly at a competitive price. These limitations on material usage and equipment/process complexity are also constraints on the design of a non-removable closure/container system where it is desired that a customer be unable to remove the closure and refill (reuse) the container. However, the material and cost constraints make it even more difficult to design a cost-effective closure/container system with sufficient structural integrity to withstand (resist) customer attempts to remove the closure.

SUMMARY OF THE INVENTION

The present invention provides a dual-seal liner, positionable between a closure and container, for forming a non-removable closure assembly. The liner includes induction heat seal bonding areas for sealing to a both a top sealing surface TSS surrounding the mouth of a plastic container, and to an inner top wall of a closure cap. The liner is disposed between the closure cap and the TSS of the container and then induction heat seal bonded to both, thus rendering the closure cap non-removable from the container. The liner further includes a conductive heat bonding area that bonds to another portion of the inner cap wall to effectively seal (prevent exposure of) an upper portion of the liner from the product being dispensed from the container.

In accordance with one embodiment, a dual-seal liner is provided for forming a non-removable closure assembly between the liner, a cap and a container, comprising:

the dual-seal liner comprising a disc-shaped body having opposing top and bottom surfaces and a peripheral edge extending in a thickness direction between the top and bottom surfaces;

the dual-seal liner comprising an upper liner component ULC stacked, in the thickness direction, above a lower liner component LLC, the dual-seal liner configured to form both inductive heat seal and conductive bonding areas to a cap and container as follows:

- the ULC having a ULC dispensing aperture disposed in a central area of the liner, and an inductive heat seal bonding area A disposed on a top surface of the ULC between the central area and the peripheral edge of the liner for bonding to a mating inductive heat seal bonding area A' on an inner top wall of the cap;
- the ULC having an inductive heat seal bonding area B disposed on a bottom surface of the ULC and lying below area A in the thickness direction, for bonding to a mating inductive heat seal bonding area B' on a top surface of the LLC;
- the LLC having an LLC dispensing aperture disposed in the central area and an inductive heat seal bonding area C disposed on a bottom surface of the LLC and lying below area B' in the thickness direction, for bonding to a mating inductive heat seal bonding area C' on a top sealing surface TSS surrounding a mouth of a container;

wherein the respective mating inductive heat seal bonding areas A and A', B and B', C and C' are aligned in the thickness direction with the TSS and are configured to form a non-removable closure assembly by inductive heat seal bonding of the TSS, the liner and the inner top wall of the cap; and further the LLC top surface having a conductive heat bonding area D, disposed between the LLC dispensing aperture and the area B', for bonding to a mating conductive bonding area D' on the inner top wall of the cap, the area D' being disposed between a cap dispensing aperture in the top wall of the cap and the ULC dispensing aperture thus allowing a product to be dispensed through the dispensing apertures of the liner and cap of the non-removable closure assembly without exposing the dispensing product to the ULC.

In one embodiment, the area A' is disposed between the cap dispensing aperture and a peripheral sidewall of the cap, to prevent leakage of the product being dispensed through the liner and cap apertures of the non-removable closure assembly.

In one embodiment, the ULC is donut shaped with a central through-hole formed by an edge extending in the thickness direction between the top and bottom surfaces of the ULC, the through-hole forming the ULC dispensing aperture and the mating bonding areas D, D' being disposed radially inwardly of the edge in a direction transverse to the thickness direction.

In one embodiment, the ULC includes an inductive heating layer for heating one or more of the heat seal bonding areas, and the inductive heating layer extends to the edge of the through-hole.

In one embodiment, the ULC comprises upper and lower ULC layers having areas A and B respectively, and an inductive heating layer lying between the upper and lower ULC layers for heating one or more of the mating heat seal bonding areas A and A', B and B', and C and C'.

In one embodiment, the inductive heating layer is configured for heating all of the heat seal bonding areas A and A', B and B', and C and C'.

In one embodiment, the ULC and LLC are each donut shaped with a central through-hole of each forming the respective ULC and LLC dispensing apertures, and wherein the ULC through-hole has a diameter in a range of 2 to 5 times larger than a diameter of the LLC through-hole.

In one embodiment, the diameter of the ULC through-hole is in a range of +/−20% of a diameter of the cap In one embodiment, the LLC dispensing aperture is in the form of a slit extending in a thickness direction through the LLC.

In one embodiment, the ULC and LLC dispensing apertures are each in the form of a through-hole extending through the ULC and LLC respectively, and the ULC through-hole has a diameter that is larger than a diameter of the LLC through-hole.

In one embodiment, the liner has a peripheral edge that is substantially equal in diameter to a peripheral edge of the TSS.

In one embodiment, the heat seal bonding areas comprise polymer materials that bond in a temperature range of form 60 to 210 degrees Celsius (140 to 410 degrees Fahrenheit).

In one embodiment, the polymer materials of the heat seal bonding areas comprise one or more of polyolefin, polyester, and nylon materials. In various embodiments: two or more of the heat seal bonding areas are polyolefin materials; two or more of the heat seal bonding areas are polyester materials; the conductive bonding areas D and D' are both polyolefin materials, such as polypropylene materials; the heat seal bonding areas A and A' are polyolefin materials, such as polypropylene materials; the heat seal bonding areas B and B' are polyolefin materials, such as polypropylene materials; the heat seal bonding areas of C and C' are polyester materials, such as polyethylene terephthalate (PET) materials.

In one embodiment, a non-removable closure assembly is provided comprising the dual-seal liner, attached by the mating heat seal bonding areas and mating conductive heat bonding areas between the cap and container.

In one embodiment, a method of forming a non-removable closure assembly is provided comprising:

providing the dual-seal liner positioned between the inner top wall of the cap and the TSS of the container, applying a conductive heating source to conductively bond mating areas D and D' together, and applying an inductive heating source to inductively heat seal bond mating areas A and A', B and B' and C and C' together respectively.

In one embodiment, a non-removable closure assembly is provided comprising the dual-seal liner and a plastic closure cap:

the liner including an inductive heating layer;

the plastic closure cap having the top wall including the cap dispensing aperture, a cylindrical skirt depending downwardly from the top wall and disposed radially outwardly with respect to the cap dispensing aperture, the area A comprising a closure sealing surface on a lower surface portion of the top wall and disposed radially outwardly of the cap dispensing aperture and radially inwardly of the skirt, and configured to be aligned above the top sealing surface (TSS) surrounding the container mouth, a closure thread disposed on a radially inwardly facing sidewall of the skirt for engaging a mating container thread surrounding the container mouth, wherein the dual-seal liner bonds the closure cap and container TSS together to form the non-removable closure assembly.

In one embodiment of the non-removable closure assembly:

the heat seal bonding areas comprise one of more of polyolefin and polyester material layers; and the inductive heating layer is a metal foil layer.

In one embodiment of the non-removable closure assembly:

the closure sealing surface and the heat seal boding areas of the ULC are polyolefin materials and the inductive heating layer is an aluminum foil layer.

In one embodiment of the non-removable closure assembly:

the top sealing surface TSS of the container and the heat seal bonding area C are polyester materials.

In one embodiment of the non-removable closure assembly:

the heat seal bonding of the closure cap, the dual-seal liner and the TSS of the container renders the assembly non-removable by hand and able to withstand a torque of at least 50 inch-pounds (in-lbs) without loss of the heat seal bonds or distortion of the closure cap or container.

In one embodiment of the non-removable closure assembly:

the heat seal bonding is able to withstand a torque of at least 70 in-lbs.

In one embodiment of the non-removable closure assembly:

the closure cap and the container are configured for packaging of a food product, such as a food product that reacts with or corrodes the inductive heating layer, such as an oil based, vinegar based, or acidic food product, such as ketchup, mayonnaise or mustard.

In one embodiment, a sealed package is provided comprising the non-removable closure assembly filled with a food product such as an oil based, vinegar based, or acidic food product, such as ketchup, mayonnaise or mustard.

In one embodiment, a method of making the non-removable closure assembly is provided comprising steps of:

inserting the ULC and LLC of the liner into the closure cap, either separately or together, with the top surface of the ULC adjacent the closure sealing surface, attaching the closure cap to the container by applying a torque to engage the mating threads of the closure and container, with dual-seal liner positioned in the area between the closure sealing surface and the top sealing surface (TSS), activating the inductive heating layer to heat seal bond the respective layers of the closure cap, the liner and the TSS of the container.

In one embodiment:

the inserting step comprises inserting the ULC and the LLC as two separate components into the closure cap.

In one embodiment, the method further comprises:

forming the ULC without the ULC dispensing aperture, and then punching through the ULC thickness to form the ULC dispensing aperture and an exposed side edge of the inductive heating layer.

In one embodiment, the method further comprises:

forming the LLC without the LLC dispensing aperture, and then punching through the LLC thickness to form the LLC dispensing aperture.

In one embodiment:

the activating step comprises applying an inductive heating source that applies a top load to the closure cap, liner and TSS while activating the inductive heating layer.

In one embodiment of the non-removable closure assembly, the plastic closure cap comprises a flip top cover joined by a hinge to a lower closure portion, the lower closure portion having the top wall with the cap dispensing aperture and the flip top cover configured to cover the cap dispensing aperture in a closed position.

In one embodiment of the non-removable closure assembly, the cylindrical skirt of the plastic closure cap comprises an inner skirt, the plastic closure also having an outer skirt depending downwardly from the top wall and disposed radially outwardly with respect to the inner skirt.

In one embodiment of the non-removable closure assembly:

the container is a plastic container having a longitudinal axis and an upper cylindrical neck finish that forms the mouth and TSS and with one or more thread segments symmetrically disposed around an outer wall of the finish;

the cap is plastic closure cap having a cylindrical inner skirt, extending downwardly from the top wall, the inner skirt having an inner wall having one or more thread segments configured to mate with the thread segments of the container finish, and an outer skirt extending downwardly from the top wall and disposed radially outwardly from the inner skirt.

In one embodiment, the inner skirt is of a lesser height than the outer skirt with respect to the longitudinal axis.

In one embodiment, the cap has a top wall, a downwardly extending outer peripheral sidewall or skirt, and a downwardly extending inner skirt disposed radially inwardly and of a lesser height than the outer skirt, wherein the height is defined with respect to a central container axis. Providing the bonded areas radially inward of the inner skirt, and more preferably having an inner skirt of lesser height, makes it more difficult to access the heat seal bonded areas if attempts are made to remove the closure. In one embodiment, the finish is relatively more rigid than the closure.

In one embodiment, the closure and/or the finish are each an injection molded article. The finish and closure may be molded from plastic materials such as polyolefins, e.g. polypropylene or polyethylene, or polyesters, e.g. PET. Alternatively, the finish and/or closure may be extrusion or compression molded. The finish may also be blow molded or otherwise expanded after initial molding.

In one embodiment, there are at least two diametrically opposed thread segments on each of the closure and finish. The finish thread segments may have overlapping ends, as well as the closure thread segments; this provides greater rigidity and resistance to removal of the closure. Depending on the finish size, there may be four, six or more sets of diametrically opposed thread segments on each of the closure and finish.

In one embodiment, the container finish and closure form a standing end, e.g. of a top down or inverted container.

BRIEF DESCRIPTION OF THE DRAWINGS

The above and further advantages of various embodiments of the invention may be better understood by referring to the following description in conjunction with the accompanying drawings in which:

in FIG. 9A the upper liner component is positioned in the closure cap; in FIG. 9B the lower liner component is positioned over the upper liner component in the cap; in FIG. 9C a conductive heat bonding source is used to bond the lower liner component to the inner top wall of the cap; in FIG. 9D the cap (with conductive bonded liner) is threaded onto the neck finish of the (previously filled) container; and in FIG. 9E an inductive heating source is applied to heat seal bond the various mating inductive heat seal bonding areas of the liner, cap and container TSS together.

DETAILED DESCRIPTION

Figure 1:
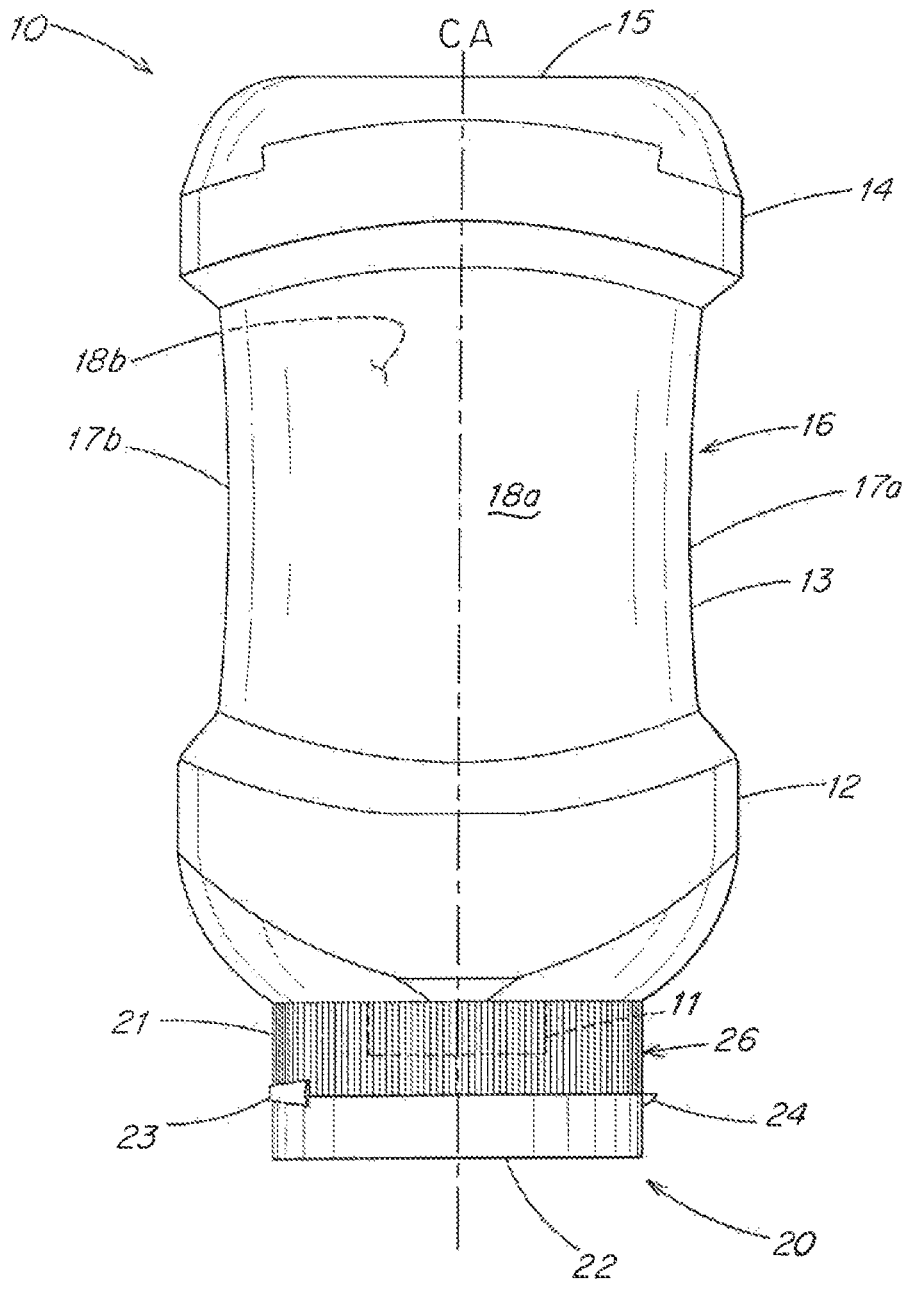
FIG. 1 is a perspective view of an inverted (upside-down) food container and non-removable closure assembly according to one embodiment of the invention, the non-removable closure assembly comprising a dual-seal liner bonded to both a closure cap and a top sealing surface TSS surrounding the mouth of the container, and the closure cap having a dispensing aperture and hinged cover (flip top) that when opened, allow dispensing of the product from the container.
Figure 2:
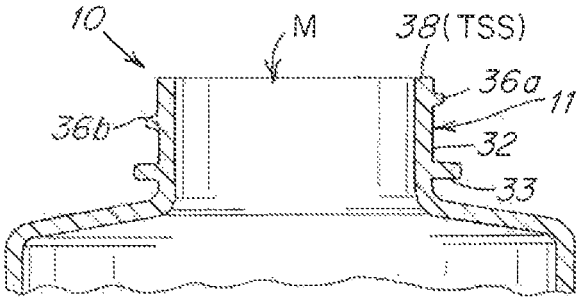
FIG. 2 is a partial vertical sectional view of the dispensing end (threaded neck finish) of the container of FIG. 1, with the closure cap removed, and the container rotated 180 degrees so the finish is facing up.
Figure 3:
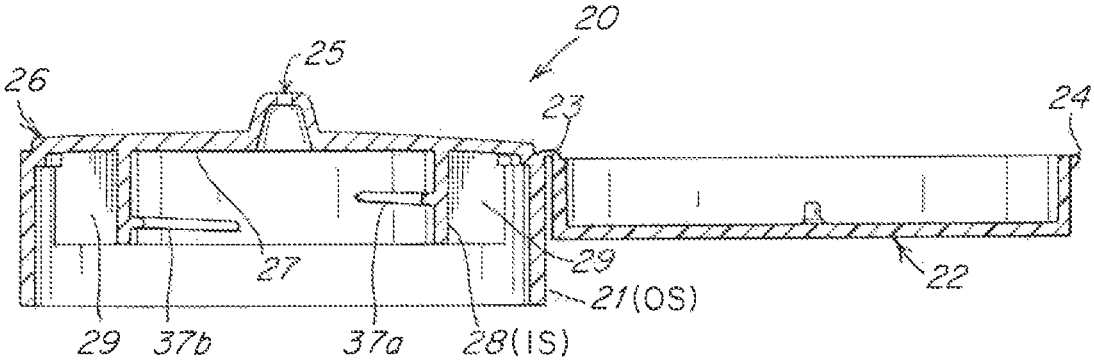
FIG. 3 is a vertical sectional view of the closure cap of FIG. 1, removed from the container and rotated 180 degrees (same as container finish of FIG. 2), showing the hinged cover in the open position, a lower portion of the cap including a top wall having a central dispensing aperture, a peripheral sidewall (outer skirt) depending downwardly from the top wall, and an inner skirt (also depending downwardly and disposed radially inwardly from the outer skirt) having a threaded portion (for mating with the threaded neck finish of the container).
Figure 4:
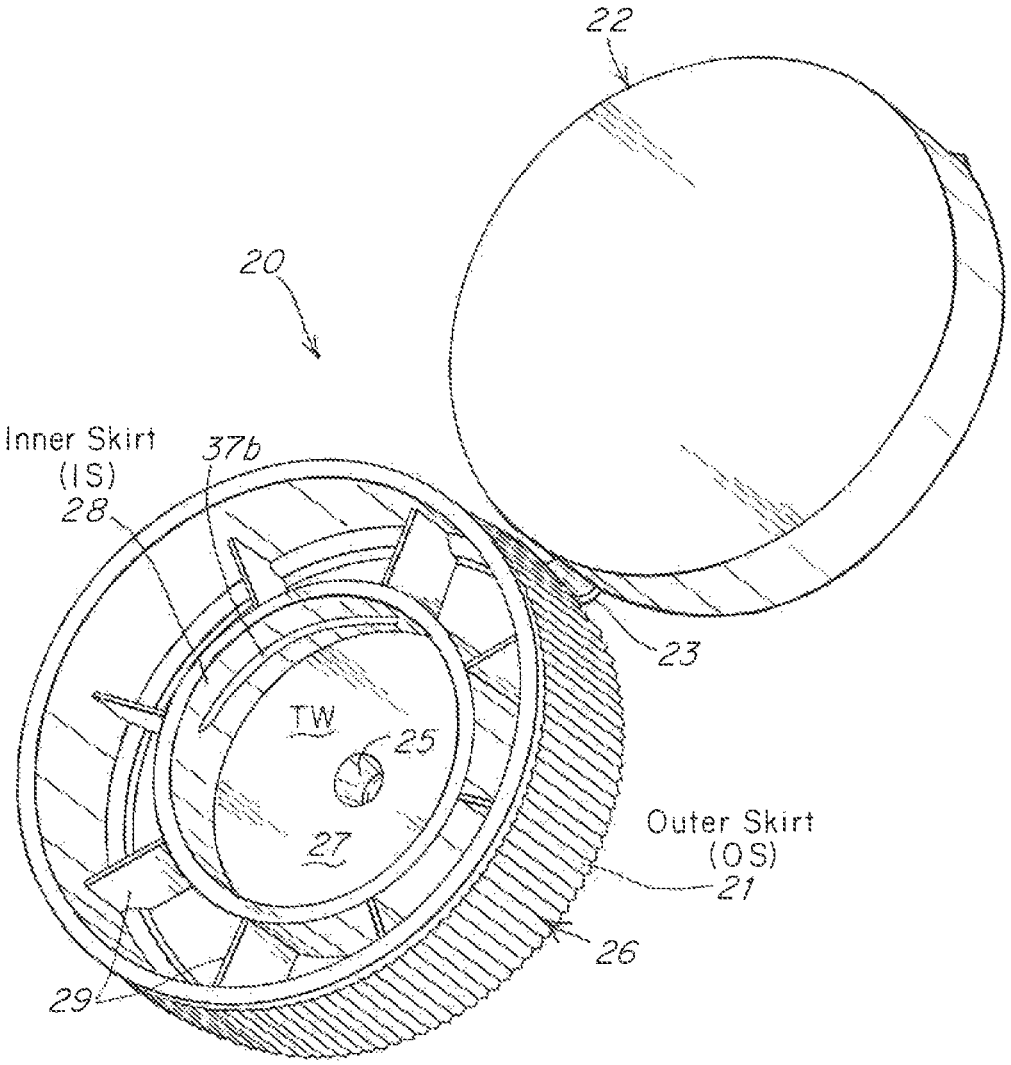
FIG. 4 is a perspective bottom view of the interior of the closure cap of FIG. 3, again showing the hinged cover (flip top) in the open position.
Figure 5:
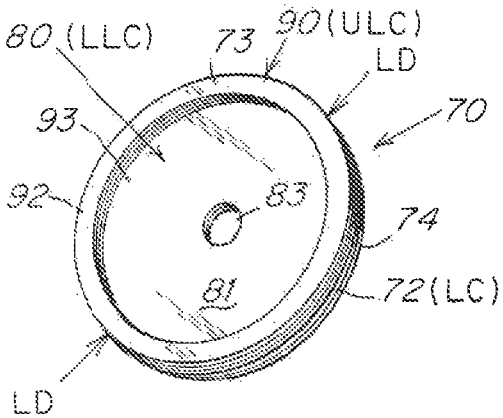
FIG. 5 is a top perspective view of a dual-seal liner according to one embodiment of the invention, configured for use with the container and closure cap of FIGS. 1-4, the dual-seal liner including a pair of vertically stacked upper and lower ring-shaped liner components.

One or more embodiments of the present invention will now be described with respect to the liner, container and closure illustrated in FIGS. 1-9E. This embodiment is given by way of example only, and is not meant to be limiting.

A. Non-Removable Closure Assembly

In one embodiment, the invention is an induction heat seal liner for sealing the finish (open end or mouth) of a plastic container, the liner being disposed between a closure cap and the container finish and being heat seal bonded to both, thus rendering the closure cap non-removable from the container finish. By non-removable it is meant that once heat seal bonded together the closure cap cannot be removed by a customer or consumer (a human) by hand, without substantially distorting the closure cap or container, e.g., it would require the human to use a mechanical tool (e.g., knife or wrench) and in the process of trying to remove the cap with the tool it would substantially deform the closure cap or container and render one or more of them unusable for their intended purpose.

In one embodiment, the heat seal liner includes an inductive heating layer, e.g., a metal layer, such as an aluminum foil layer, and adjacent plastic polymer layers which collectively form a barrier liner (e.g., preventing exposure to air and/or moisture) to prevent deterioration of the product to be sealed in the container. In one embodiment the product is ketchup, which will discolor when exposed to the atmosphere. In another example the product is mayonnaise, which will spoil when exposed to the atmosphere. The metal foil layer of the liner serves as an inductive heating element for transferring heat to other heat seal layers of the liner, causing the heat seal layers to soften (upon heating) and form a heat seal bond with an adjacent surface of the liner, finish or closure cap.

A heat seal liner for a non-removable closure system has an aperture in the liner to allow the product to be dispensed through the liner and then through a dispensing aperture in the closure. Typically the closure has a flip top cover with a plug that closes the dispensing aperture (when not in use). When the cover is opened, and the container is held upside down with the dispensing aperture facing down, the container can be squeezed to force the product through the dispensing apertures of the liner and closure.

A problem arises when forming a dispensing aperture through a thickness direction of the heat seal liner, namely the act of cutting (e.g., punching) an aperture (hole) through the liner typically exposes a cut side edge of the metal foil layer to the product being dispensed through the liner aperture. This exposure of the metal layer to the product being dispensed, especially with a product that is acidic (e.g., ketchup) or oil-based (e.g., mayonnaise or salad dressing), may compromise the ability of the metal layer to function as an effective heat seal and/or barrier liner due to foil corrosion and subsequent loss of performance, e.g., foil seal layer delamination and/or loss of the liner/finish heat seal bond. The present invention provides a liner that avoids this exposure and thus eliminates this problem.

B. Dual-Seal Liner

In accordance with the present embodiment, a dual-seal liner structure is provided to seal over the exposed inner (cut) side edge of a dispensing aperture in the liner (i.e., surrounding the liner aperture) while also heat seal bonding the liner to both the closure cap and container to provide a non-removable closure assembly. One embodiment of the dual-seal liner 70 (shown in FIGS. 5-8) will be described first, followed by a discussion of attaching the liner to a container 10 and closure 20 to provide a non-removable closure assembly 5 according to one method embodiment of the invention (shown in FIGS. 9A-9E).

A disc-shaped, two component liner body 70 is shown in FIGS. 5-8 in a positioned between and bondable to each of a closure 20 and a top sealing surface (TSS) 38 surrounding an open mouth (M) of a container 10 to form a non-removable closure assembly 5. The liner 70 of the present embodiment is of cylindrical disc-shaped form, having a circular cylindrical peripheral edge 72, opposing top and bottom planar surfaces 73, 74 aligned parallel to a base plane BP, the BP being defined by the TSS of the container finish, and having two stacked layer components (upper 90 and lower 80) stacked one above the other in a liner thickness LT direction that is perpendicular to the BP (see FIGS. 6-7). The liner circumference LC is defined by the outermost radial circular perimeter side edge 72 of the liner, having a diameter LD that is substantially equal to the outer diameter TSSD of the TSS (see FIG. 6).

In accordance with the present embodiment, the two component liner 70 comprises two substantially planar ring-shaped components, each having a central aperture, and stacked vertically one above the other in the liner thickness direction LT (also aligned with a longitudinal container axis CA) as follows: 1) a ring-shaped lower liner component 80 (LLC); and 2) a ring-shaped upper liner component 90 (ULC), both configured to lie in an area A1 between a closure sealing surface 27 and the TSS 38 surrounding the open mouth of the container (see FIGS. 6-8). The lower liner component (LLC) 80 includes a plurality of vertically stacked layers that include: a) an uppermost LLC layer 81 for inductive heat seal bonding to a lowermost layer 91 of the upper liner component (ULC), and b) a lowermost (LLC) layer 82 for inductive heat seal bonding area to the TSS 38 of the container, both 81 and 82 lying in the area A1 between the closure sealing surface 27 and the TSS 38 of the container. The LLC is ring shaped, having a centrally disposed circular dispensing aperture 83 of diameter LLD, that extends completely through the thickness of the LLC. The upper liner component 90 (ULC) includes: a) an uppermost ULC layer 92 for bonding to the closure sealing surface 27, b) a lowermost ULC layer 91 for inductive heat seal bonding to the uppermost LLC layer 81 in the area A1 between the closure sealing surface and the container TSS, and c) an inductive heating layer 94 lying between the uppermost and lowermost ULC layers 92, 91 to induce inductive heat seal bonding of all heat seal layers 81, 82, 91, 92 of the liner 70 to adjacent heat seal bonding area layers/surfaces. The upper liner component (ULC) is also ring shaped, having a centrally disposed circular dispensing aperture 93 that extends completely through the thickness of the ULC. The circular ULC aperture 93 has a diameter ULD that is larger than the diameter of the circular LLC aperture 83; both apertures 83, 93 are aligned with the longitudinal axis CA (same as the liner thickness direction LT).

The inner circular side 93*e* edge that forms (surrounds) the central aperture 93 in the upper liner component 90, includes an inner edge 94*e* of the inductive heating layer 94 that may be contacted by (exposed to) the product being dispensed through the lower liner aperture 83 and into the area of the upper liner aperture 93. This can be detrimental to the layer integrity of the upper liner component and/or the inductive heating layer 94 itself (typically Al foil). To solve this problem, a top surface area of the LLC is bonded to the interior (bottom) surface 27 of the top wall TW of the closure cap 21 so as to cover the exposed side edge 94*e* of the inductive heating layer 94, while allowing the heat seal layers 92, 82 to bond to the closure sealing surface 27 and TSS 38 respectively, thus forming a non-removable closure assembly 5 between the liner 70, closure 20 and container 10. More specifically (see FIG. 8), the LLC 80 has a top surface 81 with a conductive heat bonding area D, disposed between the LLC dispensing aperture 83 and the heat seal bonding area A1, for bonding to a mating conductive bonding area D' on an inner top wall 27 of the closure cap 21, the area D' being disposed between a cap dispensing aperture 25 in the top wall of the cap and the ULC dispensing aperture 93, thus allowing a product P to be dispensed through the ULC and LLC liner dispensing apertures 83, 93 and the cap dispensing aperture 25 of the non-removable closure assembly 5 without exposing the dispensing product P to the ULC 90. The details of this are shown in FIGS. 7-8 and described further below, following a general description of the container and closure of the present embodiment.

C. Container and Closure

FIG. 1 shows a container 10 having a closure 20 for use with the liner of the present embodiment. The container is shown "upside down" because it is designed to function as an inverted dispensing container (a.k.a. top down package) for ketchup or other viscous food products (e.g., mayonnaise, mustard), there being advantages in providing a dispensing container in which the outer top wall of the closure cap forms a standing surface of the sealed container. As is well known in the art, this facilitates, by use of gravity and squeezing the container sidewall, dispensing of the product by the consumer.

This particular container is intended for use in commercial establishments, e.g. restaurants, and is designed to provide a substantially non-removable closure assembly. This enables the product manufacturer to deliver a product filled container to the retail establishment (restaurant) and prevents any person (e.g., restaurant employee) from refilling the container with additional product. In this embodiment, the force required to remove the closure assembly is sufficiently high that the closure cannot be manually removed (by hand). Furthermore, if a mechanical element (tool) is used by an employee in an attempt to remove the closure, e.g., a long thin instrument such as a knife, the difficulty in accessing the heat seal bonded areas between the closure and finish and the respective boding strengths of the liner to the container finish and closure are such that the bottle and/or closure will be substantially deformed so as to be rendered unusable (if the employee is successful in removing the closure). Most likely the container will be crushed or buckle and thus rendered unacceptable for further use in a commercial establishment. Similarly, if the employee tries to use a wrench to separate (rotate) the closure with respect to the container finish, the closure and/or container with be crushed, buckled or otherwise deformed (rendered unusable for its intended purpose) in the process of trying to break the inductive heat seal bonds between the liner, closure and container finish.

The container 10 has an open mouth or finish portion 11 (shown generally in phantom lines in FIG. 1 as it is covered by the closure 20) and an integral body portion 16. The body portion includes a sidewall having an upper shoulder 12, a central label panel area 13, and a lower shoulder 14; below the sidewall is a closed end 15 (normally referred to as the base). The closure 20 includes a flip top cover 22 joined by a hinge 23 to a lower closure portion 26 which includes a top wall 27 having a central circular dispensing aperture 25 (see FIG. 3) and an outer circumferential sidewall or skirt 21. A lip 24 on the flip top 22 facilitates opening of the cover. In this embodiment, the container panel area 13 is substantially rectilinear comprising two pairs of diametrically opposed gripping surfaces (17*a*, 17*b* and 18*a*, 18*b* respectively). The container is otherwise generally substantially symmetrical with respect to a longitudinal container axis CA.

The container finish 11 (shown in FIGS. 1-2 and 6-8) has a cylindrical top sealing surface (TSS) 38 surrounding an open mouth (aperture) M of the container for dispensing the product, and a cylindrical thread finish portion 32 having an outer wall with two thread segments 36*a* and 36*b*, adapted to mate with complimentary thread segments 37*a* and 37*b* on an inner sidewall 28 (skirt) of the closure cap. The two thread segments on the container finish are symmetrically disposed about the circumference of the cylindrical outer wall 32, and are diametrically opposed. The thread segments have circumferentially overlapping end portions which further enhance secure attachment of the closure to the finish. Below the upper thread portion 32 is a lower support flange 33. The flange 33 is generally used for handling and/or supporting the container during manufacture or filling, and/or supporting the preform from which the container is blow molded.

FIGS. 3-4 and 6-8 show various features of the closure 20. The closure has a lower portion 26 formed by an outer cylindrical sidewall or skirt (OS) 21 which depends downwardly from a top wall 26. The top wall has a central aperture 25 for dispensing of the product; the aperture may include a nozzle fitment or valve system to prevent leakage or dispensing of the product unless the container is squeezed. An inner cylindrical sidewall or skirt (IS) 28, also extending downwardly from the top wall, is disposed radially inwardly with respect to the outer skirt 21. Connecting ribs (radial spokes) 29 are symmetrically disposed between the inner and outer skirts 28, 21, providing structural support to both the inner and outer skirts and increasing the closure's resistance to deformation by tampering or other efforts to remove the closure from the finish. The inner skirt 28 of the closure 20 has inner thread segments 37*a* and 37*b* which are designed to sit below and support the finish thread segments 36*a* and 36*b*, respectively. The outer skirt 21 is longer (in the longitudinal direction CA) than the inner skirt 28. Again this is useful for enhancing tamper resistance and preventing access to the bonded areas of the liner with each of the closure and finish.

D. Container, Closure and Liner Assembly

A non-removable closure assembly can be constructed, from the liner, closure and container previously described, in accordance with one embodiment of the invention as follows.

Figure 7:
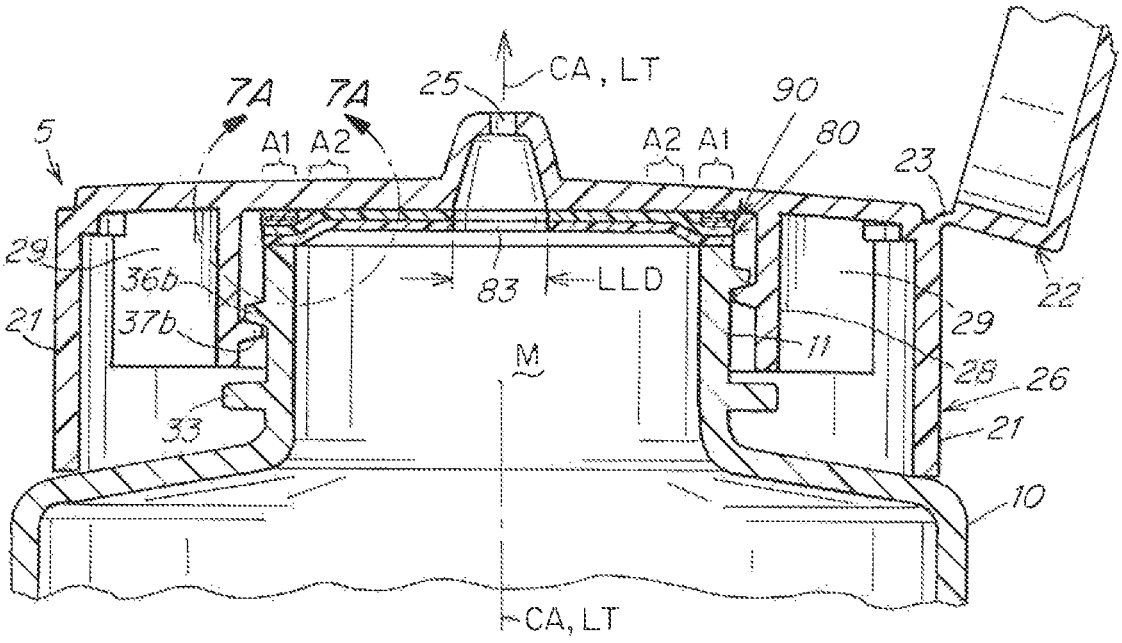
FIG. 7 is a front sectional view of the closure assembly of FIG. 6, after both inductive heat seal bonding the liner, cap and container TSS together and also conductive heat bonding the liner and cap together, rendering the assembly non-removable.
Figure 7A:
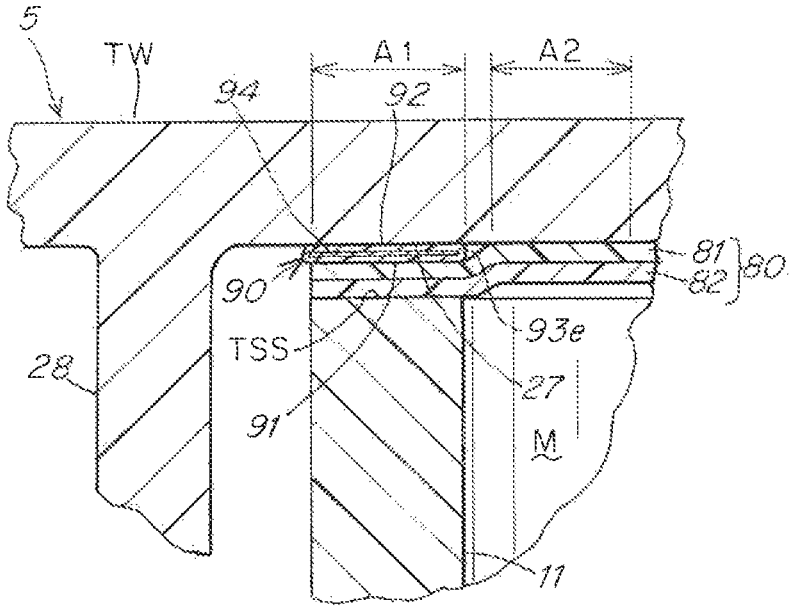
FIG. 7A is an expanded partial sectional view of a portion of the closure assembly of FIG. 7, showing both the inductive heat seal bonding and conductive heat bonding areas forming the non-removable closure assembly.

As described above, inductive heat seal bonding areas are provided on the liner in an area A1 between a container TSS and an inner top wall 27 of the closure cap to form the non-removable closure assembly (FIG. 7A). In addition, a conductive heat seal bonding area A2 is provided between the LLC 80 and the inner top wall 27 of the closure cap to prevent contact between the product P being dispensed and the ULC 90 (including the exposed inner side edge 94*e* of the metal foil inductive heating layer 94). Greater detail on these respective bonding areas, and a method of assembly, will now be provided.

Figure 6:
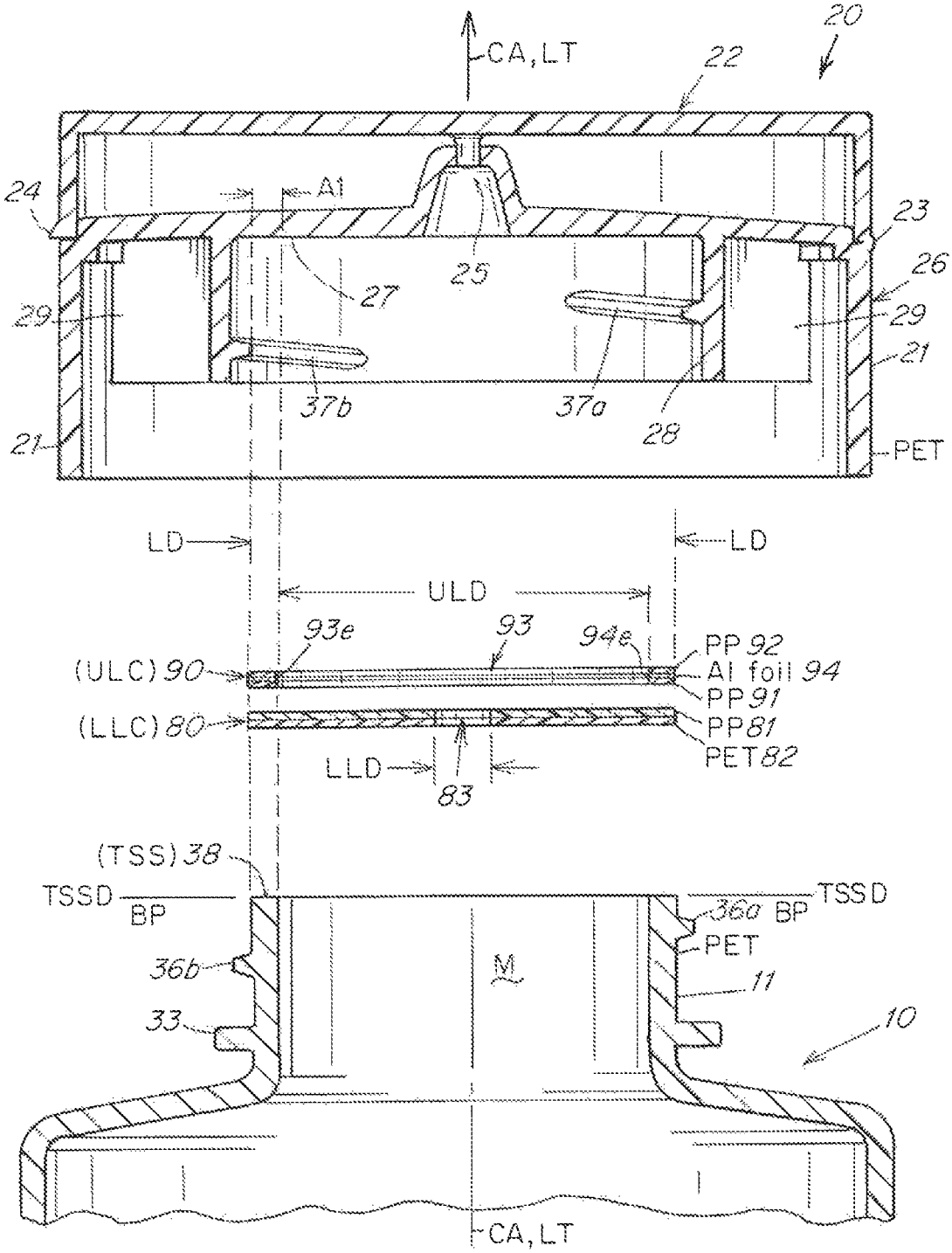
FIG. 6 is an exploded front sectional view of the cap, liner and neck finish of FIGS. 1-5 for forming a non-removable closure assembly according to one embodiment of the invention, the upper and lower liner components (of FIG. 5) being positioned between the closure cap (on top) and the container finish (below), prior to inductive heat seal bonding of the cap, liner layers and finish together, and prior to conductive heat bonding of the lower liner component to the inner top wall of the cap.
Figure 8:
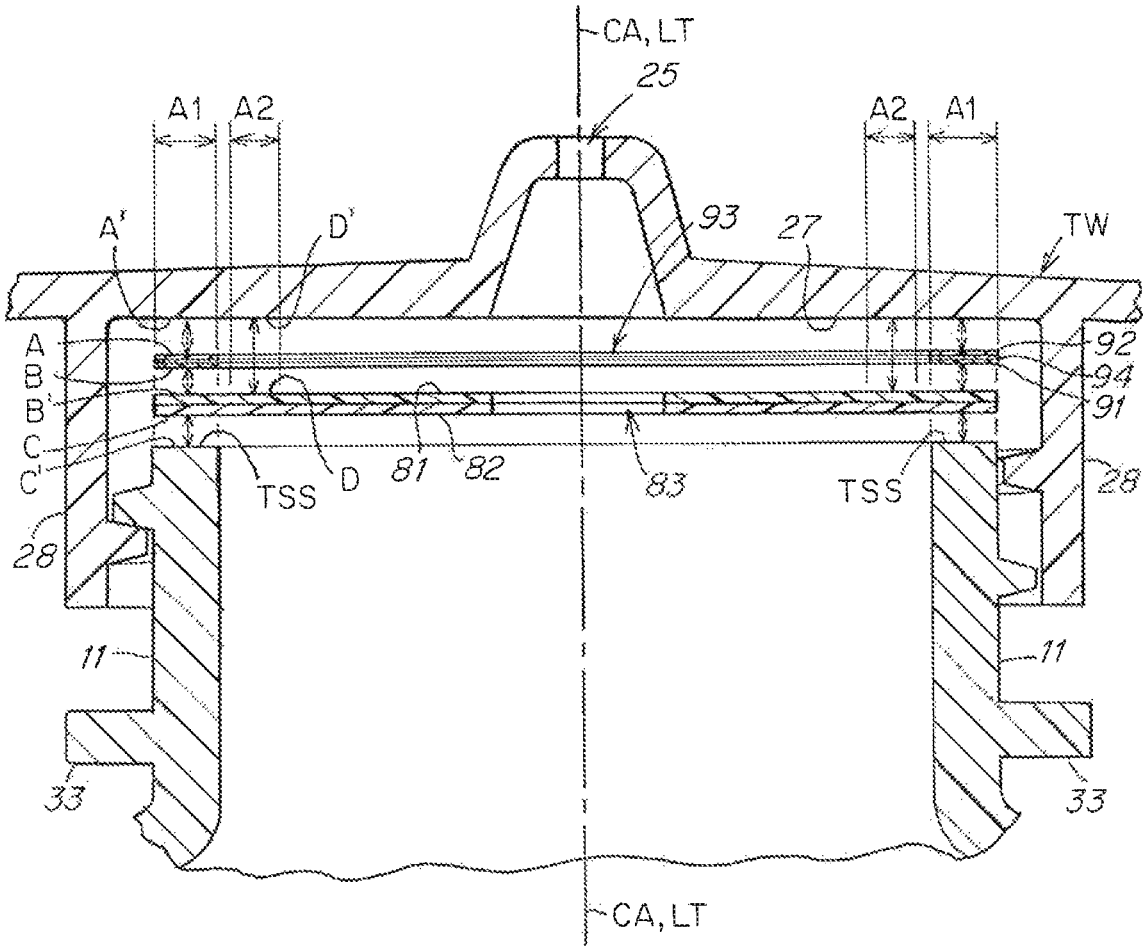
FIG. 8 is an expanded front view, similar to FIG. 6, showing the upper and lower liner components positioned between the cap and TSS of the container, showing in greater detail the respective bonding areas used to form the non-removable closure assembly.

As best shown in FIGS. 6-8, a dual-seal liner is provided for forming a non-removable closure assembly between the liner, a cap and a container, as follows:

the dual-seal liner comprising a disc-shaped body 70 having opposing top 73 and bottom 74 surfaces and a peripheral edge 72 extending in a liner thickness direction LT between the top and bottom surfaces;

the dual-seal liner comprising an upper liner component ULC 90 stacked, in the thickness direction, above a lower liner component LLC 80, the dual-seal liner configured to form both heat seal A1 and conductive A2 bonding areas to a cap 20 and container 10 as follows:

- the ULC 90 having a ULC dispensing aperture 93 disposed in a central area of the liner, and a heat seal bonding area A disposed on a top surface 92 of the ULC between the central area and the peripheral edge 72 of the liner for bonding to a mating heat seal bonding area A' on an inner top wall 27 of the cap;
- the ULC 90 having a heat seal bonding area B disposed on a bottom surface 91 of the ULC and lying below area A in the thickness direction, for bonding to a mating heat seal bonding area B' on a top surface 81 of the LLC;
- the LLC 80 having an LLC dispensing aperture 83 disposed in the central area and a heat seal bonding area C disposed on a bottom surface 82 of the LLC and lying below area B' in the thickness direction, for bonding to a mating heat seal bonding area C' on a top sealing surface TSS surrounding a mouth M of a container;

wherein the respective mating heat inductive seal bonding areas A and A', B and B', C and C' are aligned in the thickness direction with the TSS and are configured to form a non-removable closure assembly by inductive heat seal bonding of the TSS 38, the liner 70 and the inner top wall 27 of the cap; and further the LLC top surface 81 having a conductive heat bonding area D, disposed between the LLC dispensing aperture 83 and the area B', for bonding to a mating conductive bonding area D' on the inner top wall 27 of the cap, the area D' being disposed between a cap dispensing aperture 25 in the top wall of the cap and the ULC dispensing aperture 93 thus allowing a product to be dispensed through the liner and cap dispensing apertures 83, 93 and 25 of the non-removable closure assembly without exposing the dispensing product to the ULC.

The area A' is disposed between the cap dispensing aperture 25 and a sidewall 28 of the cap, to prevent leakage of the product being dispensed through the liner and cap apertures 83, 93, 25 of the non-removable closure assembly.

The ULC 90 is ring (donut) shaped with a central through-hole 93 formed by an edge 93*e* extending in the thickness direction LT between top 92 and bottom 91 surfaces of the ULC, the through-hole 93 forming the ULC dispensing aperture and the mating bonding areas D, D' being disposed radially inwardly of the edge 93*e* in a direction transverse to the liner thickness direction LT.

The ULC 90 includes an inductive heating layer 94 for heating one or more of the heat seal bonding areas, and the inductive heating layer extends to the edge 93*e* of the through-hole 93.

The ULC comprises upper 92 and lower 91 ULC layers having areas A and B respectively, with the inductive heating layer 94 lying between the upper and lower ULC layers for heating one or more of the mating heat seal bonding areas A and A', B and B', and C and C'.

The inductive heating layer 94 may be configured for heating all of the heat seal bonding areas A and A', B and B', and C and C'.

The ULC and LLC are each ring (donut) shaped with a central through-hole of each forming the respective LLC and LLC dispensing apertures, and wherein and the ULC through-hole 93 has a diameter ULD that is larger than a diameter LLD of the LLC through-hole. In one embodiment the ULC through-hole 93 has a diameter in a range of 2 to 5 times larger than a diameter LLD of the LLC through-hole 83. The diameter of the ULC through-hole may be in a range of +/−20% of a diameter of the cap dispensing aperture 25.

In another embodiment, the LLC dispensing aperture 83S is in the form of a slit extending in a thickness direction through the LLC.

The liner may have a peripheral edge 72 that is substantially equal in diameter to a peripheral edge TSSD of the TSS (see FIG. 6).

The heat seal bonding areas may comprise polymer materials that bond in a temperature range of from 60 to 210 degrees Celsius (140 to 410 degrees Fahrenheit).

The polymer materials of the heat seal bonding areas may comprise one or more of polyolefin, polyester, and nylon materials.

The heat seal bonding areas B and B' may be polyolefin materials, such as polypropylene materials.

The heat seal bonding areas C and C' may be polyester materials, such as polyethylene terephthalate (PET) materials.

Figure 9A:
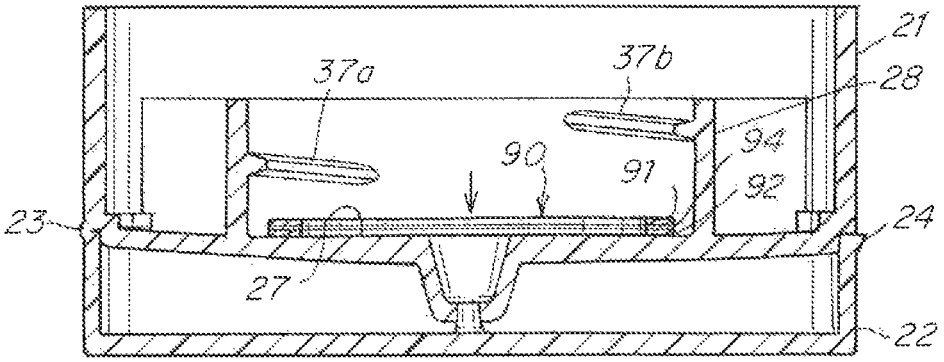
FIGS. 9A-9E show a series of method steps for forming the non-removable closure assembly according to one embodiment of the invention.
Figure 9B:
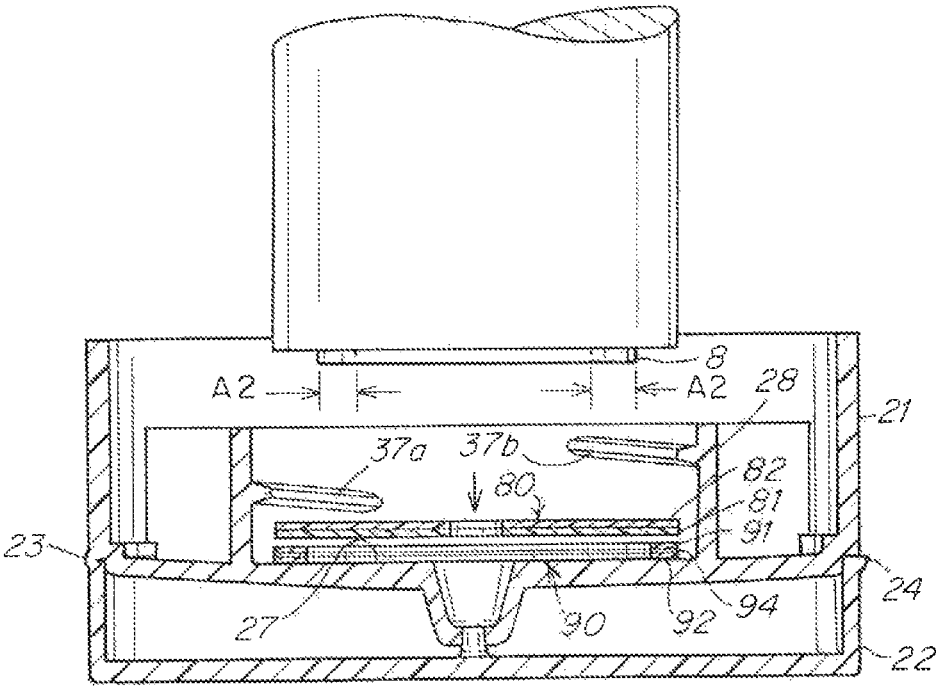
Figure 9C:
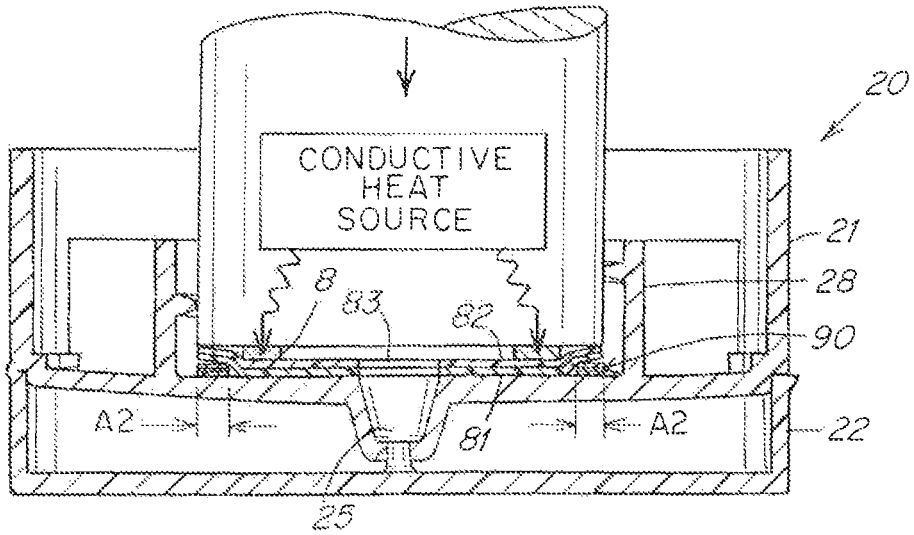
Figure 9D:
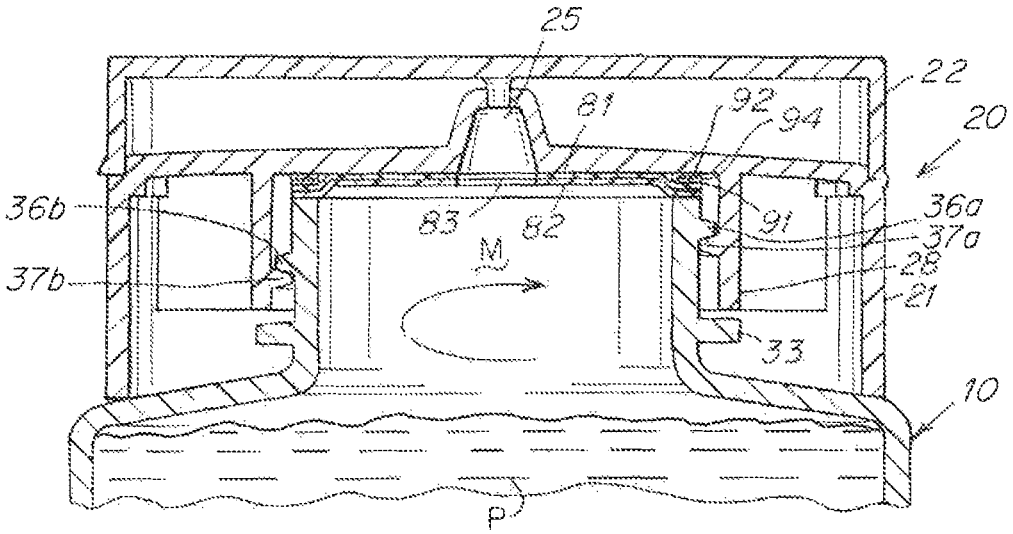
Figure 9E:
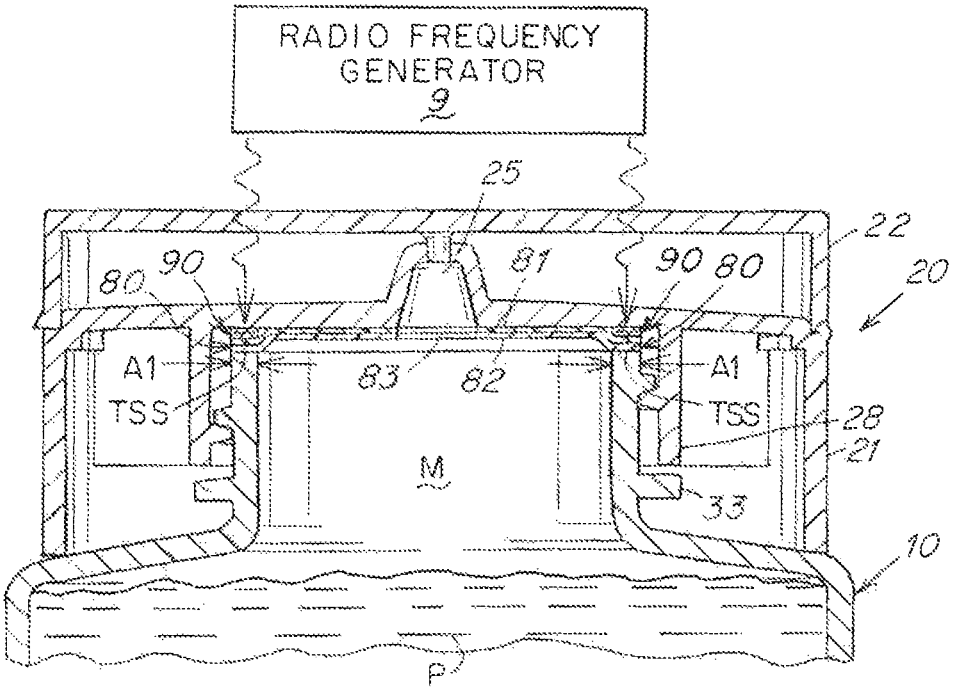

A method of forming a non-removable closure assembly is shown in FIGS. 9A-9E and includes steps of:

- positioning the upper liner component ULC 90 in the closure cap 20, with ULC layer 92 adjacent the inner top wall 27 of the cap, radially inwardly of the inner skirt 28 (FIG. 9A);
- positioning the lower liner component LLC 80 aligned over the upper liner component ULC 90 in the cap, with LLC layer 81 adjacent ULC layer 91 (FIG. 9B);
- applying a conductive heating source 8 (e.g., heat ring, with resistive contact heating) to conductively bond mating areas D and D' together in area A2 (FIG. 9C);
- positioning the cap 20 and attached liner 70 onto the container finish 11 (of the previously filled container) with the dual-seal liner positioned between the inner top wall 27 of the cap and the TSS 38 of the container finish 11, and applying (threading by rotation and engagement of mating threads 36*a*/37*a* and 36*b*/37*b*) the cap 20 onto the finish 11) (FIG. 9D); and
- applying an inductive heating source 9 to inductively heat seal bond mating areas A and A', B and B' and C and C' together respectively in area A1 between the TSS and inner top wall 27 of the cap 20 (FIG. 9E).

There has thus been described an embodiment of the present invention comprising a inductive heat seal bonding mechanism for preventing reverse (loosening) rotation of the closure by application of manual force. The amount of force required to overcome the bonding is sufficiently high that the closure cannot be manually removed. In one embodiment, the bonding of the closure, the two component liner and the TSS of the container renders the assembly non-removable by hand, optionally able to withstand a torque of at least 50 inch-pounds (in-lbs) (e.g., for a 33 millimeter (mm) diameter container finish), optionally able to withstand a torque of at least 70 in-lbs (e.g., for a 38 mm diameter container finish), without loss of the heat seal bonds or distortion of the closure or container finish.

In one embodiment, if a user attempts to deform the container or closure either manually or with a tool in order to gain access to the bonding areas, such efforts are substantially thwarted by providing the inductive bonding areas A and A', B and B', C and C' radially inwardly of the inner skirt 28 of the closure 20. Because this inner skirt 28 is radially (laterally) inwardly disposed with respect to the outer skirt 21, and also of a lesser height, simple insertion of a knife beneath the lower edge of the outer skirt will not be sufficient to engage or disrupt the bonding areas. Generally, the structural integrity of each of the closure and container will be such that any successful effort to reach the bonding areas and overcome the bonding force will substantially deform either the closure or container (or both) such that they will be rendered unusable.

In alternative embodiments, the placement of the bonding areas and the structural configuration of the various components and the materials thereof can be varied to suit a particular application. Also, the number of thread segments can be varied. Preferably there are at least two thread segments which are preferably diametrically opposed, so that the forces between the closure and finish are evenly distributed around the circumference of the closure and finish. Preferably, the thread segments have overlapping ends for greater engagement of the closure and finish thread segments.

The material used for the closure and finish will depend upon the particular application. In the present embodiment, the closure is made of polypropylene, and the container is made from bottle grade polyethylene terephthalate (PET) resin. The container is made from an injection molded preform, the body portion of which is blow molded to form the container body. The finish has an outer diameter of 33 mm, a wall thickness (upper portion 32) of 0.088 inch, and a thread diameter (T dimension) of 1.255 inch; the sidewall thickness of the container is about 0.63 mm. The closure in the present embodiment is injection molded. The closure has an inside wall diameter of about 33 mm, a wall thickness of 0.045 inch, a thread diameter on the inside wall (E dimension) of 1.224 inch, and a thread diameter (TD dimension) of 1.280 inch. For greater rigidity, both the finish and closure can be injection molded from PET. Preferred ranges for the finish and closure are:

a) for the finish:
outer diameter 28-89 mm
wall thickness 0.045-0.110 inch
thread diameter (TD dimension) 1.078-3.494 inch
b) for the closure:
inside wall diameter 28-89 mm
wall thickness 0.030-0.110 inch
thread diameter on inside wall (E dimension) 1.047-3.463 inch wall diameter 1.103-3.519.

The container body (sidewall or weakest area) would typically have a wall thickness of 0.015-0.080 inch.

In alternative embodiments, the container and/or finish may be extrusion molded or compression molded. The finish may also be blow molded or otherwise expanded after the initial molding step.

There are various advantages to providing a substantially non-removable and substantially non-rotatable closure and finish assembly. One benefit is to provide security to the customer that the product has not been tampered with. A second benefit is an improvement of the mechanical seal between the top sealing surface and the closure, which prevents leakage. One or more of these advantages may be useful in a particular application.

These and other modifications would be readily apparent to the skilled person as included within the scope of the described invention.

The invention claimed is:

1. A dual-seal liner (70) configured to form a non-removable closure assembly between the liner (70), a cap (20) and a container (10), the dual seal liner (70) comprising:

a disc-shaped body (70) having opposing top and bottom surfaces (73, 74) and a peripheral edge (72) extending in a thickness direction between the top and bottom surfaces (73, 74);

wherein the top and bottom surfaces (73, 74) have respective inductive heat seal bonding areas (A, C) which are aligned in the thickness direction (LT) for forming a non-removable closure assembly by inductive heat seal bonding to cap (20) and container (10) respectively;

the dual-seal liner (70) further comprising an upper liner component (90) stacked, in the thickness direction (LT), above a lower liner component (80):

the upper liner component (90) having an upper liner component ULC dispensing aperture (93) disposed in a central area of the liner (70), and a first inductive heat seal bonding area (A) disposed on a top surface (92) of the upper liner component (90) between the central area and the peripheral edge (72) of the liner (70) for bonding to a further mating inductive heat seal bonding area (A') on an inner top wall (27) of the cap (20);

the upper liner component (90) having a second inductive heat seal bonding area (B) disposed on a bottom surface (91) of the upper liner component (90) and lying below the first inductive heat seal bonding area (A) in the thickness direction (LT), for bonding to a mating inductive heat seal bonding area (B') on a top surface (81) of the lower liner component (80);

the lower liner component (80) having a dispensing aperture (83) disposed in the central area and a fourth inductive heat seal bonding area (C) disposed on a bottom surface (82) of the lower liner component and lying below the third inductive heat seal bonding area (B') in the thickness direction (LT), for bonding to a further mating inductive heat seal bonding area (C') on a top sealing surface (38) surrounding a mouth (M) of container (10);

the upper liner component (90) having an inductive heating layer (94) for heating one or more of the first, second, third and fourth inductive heat seal bonding areas (A, B, B', C); and further a top surface (81) of the lower liner component (80) having a conductive heat bonding area (D), disposed between the lower liner component dispensing aperture (83) and the third inductive heat seal bonding area (B') for bonding to a mating conductive heat bonding area (D') on inner top wall (27) of cap (20).

2. The dual-seal liner of claim 1, wherein:

the upper liner component (90) donut shaped with a central through-hole formed (93) by an edge (93*e*) extending in the thickness direction (LT) between the top and bottom surfaces (92, 91) of the upper limit component (90), the through-hole (93) forming the upper liner component dispensing aperture (93) and the conductive heat bonding areas (D) being disposed radially inwardly of the edge (93*e*) in a direction transverse to the thickness direction (LT).

3. The dual-seal liner of claim 2, wherein:

the inductive heating layer (94) extends to the edge of the through-hole (93).

4. The dual-seal liner of claim 1, wherein:
the upper liner component (90) comprises upper and lower layers (92, 91) having the first and second heat seal bonding areas (A, B) respectively, and the inductive heating layer (94) lies between the upper and lower layers (92, 91) for heating one or more of the first, second, third and fourth inductive heat seal bonding areas (A, B, B', C).

5. The dual-seal liner of claim 4, wherein:
the inductive heating layer (94) is configured for heating all of the first, second, third and fourth inductive heat seal bonding areas (A, B, B', C).

6. The dual-seal liner of claim 4, wherein:
the polymer materials of the first, second, third and fourth inductive heat seal bonding areas (A, B, B', C) comprise one or more of polyolefin, polyester, and nylon materials.

7. The dual-seal liner of claim 1, wherein:
the upper liner component (90) and lower liner component (80) are each donut shaped with a central through-hole (93, 83) of each forming the respective dispensing apertures (93, 83) of the upper liner component (90) and lower liner component (80), and wherein the through-hole (93) of the upper liner component (90) has a diameter in a range of 2 to 5 times larger than a diameter of the through-hole (83) of the lower liner component (80).

8. The dual-seal liner of claim 1, wherein:
the dispensing aperture (83) of the lower liner component (80) is in the form of a slit extending in a thickness direction (LT) through the lower liner component (80).

9. The dual-seal liner of claim 1, wherein:
the dispensing apertures (93, 83) of the upper liner component (90) and the lower liner component (80) are each in the form of a through-hole (93, 83) extending through the upper liner component (90) and lower liner component (80) respectively, and the ULC through-hole (93) of the upper liner component (90) has a diameter that is larger than a diameter of the LLC through-hole (83) of the lower liner component (80).

10. The dual-seal liner of claim 1, wherein:
the first, second, third and fourth inductive heat seal bonding areas (A, B, B', C) comprise polymer materials that bond in a temperature range of form 60 to 210 degrees Celsius (140 to 410 degrees Fahrenheit).

11. The dual-seal liner of claim 10, wherein:
two or more of the first, second, third and fourth inductive heat seal bonding areas (A, B, B', C) are polyolefin materials.

12. The dual-seal liner of claim 10, wherein:
two or more of the first, second, third and fourth inductive heat seal bonding areas (A, B, B', C) are polyester materials.

13. The dual-seal liner of claim 1, wherein:
the conductive bonding areas (D) of the lower liner component (80) is a polyolefin materials, such as a polypropylene materials.

14. The dual-seal liner of claim 1, wherein:
the first heat seal bonding areas (A) is a polyolefin materials, such as a polypropylene materials.

15. The dual-seal liner of claim 1, wherein:
the second and third heat seal bonding areas (B, B') are polyolefin materials, such as polypropylene materials.

16. The dual-seal liner of claim 1, wherein:
the fourth heat seal bonding area (C) is polyester materials, such as a polyethylene terephthalate (PET) materials.

17. A non-removable closure assembly comprising the dual-seal liner of claim 1 combined with cap (20) and container (10), wherein the dual seal liner (70) is attached by the first inductive heat seal bonding area (A) bonded to a mating inductive heat seal bonding area (A') on an inner top wall (27) of the cap (20), by the fourth inductive heat seal bonding area (C) bonded to a mating inductive heat seal bonding area (C') on a top sealing surface (38) surrounding a mouth (M) of the container (10), and by the conductive heat bonding area (D) bonded to a mating conductive heat bonding area (D') on the inner top wall (27) of the cap (20).

18. The non-removable closure assembly of claim 17 wherein:
the heat seal bonding areas (A, A', C, B', C, C') comprise one of more of polyolefin and polyester material layers; and the inductive heating layer (94) is a metal foil layer.

19. The non-removable closure assembly of claim 18 wherein:
the top sealing surface (27) and the first and second inductive heat seal boding areas (A, B) are polyolefin materials and the inductive heating layer (94) is an aluminum foil layer.

20. The non-removable closure assembly of claim 19 wherein:
the top sealing surface (38) of the container (10) and the fourth inductive heat seal bonding area (C) are polyester materials.

21. The non-removable closure assembly of claim 17 wherein:
the heat seal bonding of the cap (20), the dual-seal liner (70) and the top sealing surface (38) of the container (10) renders the assembly non-removable by hand and able to withstand a torque of at least 50 inch-pounds (in-lbs) without loss of the heat seal bonds or distortion of the cap (20) or container (10).

22. The non-removable closure assembly of claim 21 wherein:
the heat seal bonding is able to withstand a torque of at least 70 in-lbs.

23. The non-removable closure assembly of claim 17 wherein:
the cap (20) and the container (10) are configured for packaging of a food product that reacts with or corrodes the inductive heating layer.

24. A sealed package comprising the non-removable closure assembly of claim 23 filled with a food product comprising an oil based, vinegar based, or acidic food product.

25. The non-removable closure assembly of claim 17, wherein
the cap (20) comprises a flip top cover (22) joined by a hinge (23) to a lower closure portion (26), the lower closure portion (26) having the top wall (27) with the cap dispensing aperture (25) and the flip top cover (22) configured to cover the cap dispensing aperture (25) in a closed position.

26. The non-removable closure assembly of claim 17 wherein
the cylindrical skirt (28) of the cap (20) comprises an inner skirt (28), the cap also having an outer skirt (21) depending downwardly from the top wall (27) and disposed radially outwardly with respect to the inner skirt (28).

27. The non-removable closure assembly of claim 17 wherein:
the container (10) is a plastic container (10) having a longitudinal axis (CA) and an upper cylindrical neck finish (11) that forms the mouth (M) and top sealing surface (38) and with one or more thread segments (36*a*, 36*b*) symmetrically disposed around an outer wall of the finish (11);

the cap (20) is a plastic cap (20) having a cylindrical inner skirt (28), extending downwardly from the top wall (27), the inner skirt (28) having an inner wall (21) having one or more thread segments (37*a*, 37*b*) configured to mate with the thread segments (36*a*, 36*b*) of the container finish (11), and an outer skirt (21) extending downwardly from the top wall (27) and disposed radially outwardly from the inner skirt (28).

28. The non-removable closure assembly of claim 27, wherein the inner skirt (28) is of a lesser height than the outer skirt (21) with respect to the longitudinal axis (CA).

29. The non-removable closure assembly of claim 17 wherein: the mating conductive bonding area (D') on the inner top wall (27) of the cap (20) is disposed between a cap dispensing aperture (25) in the top wall (27) of the cap (20) and the upper liner component dispensing aperture (93) thus allowing a product to be dispensed through the dispensing apertures (83, 93) of the liner (70) and cap (20) of the non-removable closure assembly without exposing the dispensing product to the upper liner component (90) and the further mating inductive heat seal bonding area (A') on the inner top wall (27) of the cap (20) is disposed between the cap dispensing aperture (25) and a peripheral sidewall (28) of the cap (20), to prevent leakage of the product being dispensed through dispensing apertures (83, 93) of the liner (70) and cap (20) of the non-removable closure assembly.

30. A method of making the non-removable closure assembly of claim 17, comprising steps of:

inserting the upper liner component (90) and lower liner component (80) of the liner (70) into the cap (20), either separately or together, with the top surface (92) of the upper liner component (90) adjacent the top sealing surface (27), attaching the cap (20) to the container (10) by applying a torque to engage the mating threads (37*a*, 37*b*; 36*a*, 36*b*) of the closure (20) and container (10), with dual-seal liner (70) positioned in the area between the closure sealing surface (92) and the top sealing surface (38), activating the inductive heating layer (94) to heat seal bond the respective layers of the cap (20), the liner (70) and the top sealing surface (38) of the container (10).

31. The method of claim 30, wherein the inserting step comprises inserting the upper liner component (90) and lower liner component (80) as two separate components into the cap (20).

32. A liner and cap assembly comprising the dual-seal liner (90) of claim 1 combined with cap (20):

the cap (20) having inner top wall (27) including a cap dispensing aperture (25), a cylindrical skirt (28) depending downwardly from the inner top wall (27) and disposed radially outwardly with respect to the cap dispensing aperture (25), the first inductive heat seal bonding area (A) comprising a closure sealing surface (27) on a lower surface portion of the inner top wall (27) and disposed radially outwardly of the cap dispensing aperture (25) and radially inwardly of the skirt (28), and configured to be aligned above top sealing surface (38) surrounding container mouth (M), a closure thread (37*a*, 37*b*) disposed on a radially inwardly facing sidewall of the skirt (28) for engaging a mating container thread (36*a*, 36*b*) surrounding container mouth (M), wherein the dual-seal liner (70) bonds the cap (20) and top sealing surface (38) of container (10) together to form the non-removable closure assembly.

33. A method of forming a non-removable closure assembly comprising:

providing the dual-seal liner (70) of claim 1 positioned between an inner top wall (27) of a cap (20) and a top sealing surface (38) surrounding a mouth (M) of a container (10), applying a conductive heating source to conductively bond together the conductive heat bonding area (D) to a mating conductive heat bonding area (D') on the inner top wall (27) of the cap (20), and applying an inductive heating source to inductively heat seal bond together, respectively, the first inductive heat seal bonding area (A) to a further mating inductive heat seal bonding area (A') on an inner top wall (27) of the cap (20), the second inductive heat seal bonding area (B) to the mating third inductive heat seal bonding area (B') on the top surface (81) of the lower liner component (80), and the fourth inductive heat seal bonding area (C) to a further mating inductive heat seal bonding area (C') on a top sealing surface (38) surrounding a mouth (M) of the container (10).

34. The method of claim 33, further comprising forming the upper liner component (90) without the dispensing aperture (93) of the upper liner component (90), and then punching through the thickness of the upper liner component (90) to form the dispensing aperture (93) of the upper liner component (90) and an exposed side edge (94*e*) of the inductive heating layer (94).

35. The method of claim 33, further comprising forming the lower liner component (80) without the dispensing aperture (83) of the lower liner component (80), and then punching through the thickness of the lower liner component (80) to form the dispensing aperture (83) of the lower liner component (80).

36. The method of claim 33, wherein the activating step comprises applying an inductive heating source that applies a top load to the cap (20), liner (70) and top sealing surface (38) while activating the inductive heating layer (94).

* * * * *